US009601852B2

(12) United States Patent
Yi et al.

(10) Patent No.: US 9,601,852 B2
(45) Date of Patent: Mar. 21, 2017

(54) EDGE-MOUNTED COAXIAL CONNECTOR

(71) Applicant: Tyco Electronics Corporation, Berwyn, PA (US)

(72) Inventors: Chong Hun Yi, Mechanicsburg, PA (US); Stephen Thomas Morley, Manheim, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 156 days.

(21) Appl. No.: 14/537,306

(22) Filed: Nov. 10, 2014

(65) Prior Publication Data

US 2016/0134041 A1 May 12, 2016

(51) Int. Cl.

| | |
|---|---|
| ***H01R 12/72*** | (2011.01) |
| ***H01R 24/50*** | (2011.01) |
| ***H01R 12/51*** | (2011.01) |
| ***H01R 12/57*** | (2011.01) |
| *H01R 107/00* | (2006.01) |
| *H01R 13/627* | (2006.01) |

(52) U.S. Cl.

CPC ..... *H01R 12/722* (2013.01); *H01R 12/515* (2013.01); *H01R 12/57* (2013.01); *H01R 24/50* (2013.01); *H01R 12/727* (2013.01); *H01R 13/6272* (2013.01); *H01R 2107/00* (2013.01)

(58) Field of Classification Search

CPC ..... H01R 12/722

See application file for complete search history.

(56) References Cited

U.S. PATENT DOCUMENTS

| | | | | |
|---|---|---|---|---|
| 3,426,311 | A * | 2/1969 | Gifford | H01P 5/085 333/238 |
| 6,065,976 | A * | 5/2000 | Wang | H01R 24/50 439/581 |
| 6,358,062 | B1 | 3/2002 | Feldman et al. | |
| 6,935,866 | B2 * | 8/2005 | Kerekes | H01R 9/0515 439/629 |
| 2002/0177332 | A1 | 11/2002 | Hubbard et al. | |
| 2004/0121625 | A1 | 6/2004 | Togashi | |

(Continued)

FOREIGN PATENT DOCUMENTS

EP 1 054 479 A1 11/2000

OTHER PUBLICATIONS

International Search Report, International Application No. PCT/US2015/058033, International Filing Date, Oct. 28, 2015.

*Primary Examiner* — James Harvey

(57) ABSTRACT

A coaxial connector includes a housing configured to be mounted to an edge of a circuit board, and coaxial contacts held by the housing. The coaxial contacts include coaxial contact pairs having a signal contact and a ground contact arranged coaxially with the signal contact of the same coaxial contact pair. The signal contacts are held by the housing such that signal mounting segments of the signal contacts are configured to extend over and be engaged in electrical contact with corresponding electrical signal traces of the circuit board when the housing is mounted to the edge of the circuit board. The ground contacts are held by the housing such that ground mounting segments of the ground contacts are configured to extend over and be engaged in electrical contact with corresponding electrical ground traces of the circuit board when the housing is mounted to the edge of the circuit board.

20 Claims, 7 Drawing Sheets

(56) References Cited

U.S. PATENT DOCUMENTS

| | | | | |
|---|---|---|---|---|
| 2007/0111596 | A1 | 5/2007 | Weidner et al. | |
| 2009/0197434 | A1 | 8/2009 | Kressner et al. | |
| 2011/0028033 | A1 | 2/2011 | Sato et al. | |
| 2011/0285415 | A1 | 11/2011 | Uesaka et al. | |
| 2016/0134041 | A1* | 5/2016 | Yi ..... | H01R 12/722<br>439/63 |

* cited by examiner

EDGE-MOUNTED COAXIAL CONNECTOR

BACKGROUND OF THE INVENTION

The subject matter described and/or illustrated herein relates generally to coaxial connectors that are mounted to circuit boards.

Coaxial connectors are known for interconnecting various coaxial components, such as coaxial cables, circuit boards, and/or the like. Coaxial connectors include one or more coaxial contact pairs. Each coaxial contact pair includes a signal contact and a ground contact that is arranged coaxially with the signal contact. Coaxial connectors are used for a wide variety of applications, such as, but not limited to, radio frequency (RF) connections.

Known coaxial connectors are not without disadvantages. For example, the contacts of at least some known coaxial connectors are fabricated using a screw-machining process. But the screw-machined contacts have a limited minimum size (i.e., screw-machined contacts can only be made so small). Accordingly, the density of the coaxial contact pairs within the coaxial connector is limited by the screw machining process used to fabricate the contacts.

There is a need for a coaxial connector having smaller contacts.

BRIEF DESCRIPTION OF THE INVENTION

In an embodiment, a coaxial connector includes a housing configured to be mounted to an edge of a circuit board, and coaxial contacts held by the housing. The coaxial contacts include coaxial contact pairs having a signal contact and a ground contact that is arranged coaxially with the signal contact of the same coaxial contact pair. The signal contacts are held by the housing such that signal mounting segments of the signal contacts are configured to extend over and be engaged in electrical contact with corresponding electrical signal traces of the circuit board when the housing is mounted to the edge of the circuit board. The ground contacts are held by the housing such that ground mounting segments of the ground contacts are configured to extend over and be engaged in electrical contact with corresponding electrical ground traces of the circuit board when the housing is mounted to the edge of the circuit board.

In an embodiment, a coaxial connector includes a housing configured to be mounted to an edge of a circuit board, and coaxial contacts held by the housing. The coaxial contacts include coaxial contact pairs that include a signal contact and a ground contact that is arranged coaxially with the signal contact of the same coaxial contact pair. The signal contacts are held by the housing such that when the housing is mounted to the edge of the circuit board: first signal mounting segments of first signal contacts of the signal contacts extend over and are engaged in electrical contact with corresponding first signal traces that extend on a first side of the circuit board; and second signal mounting segments of second signal contacts of the signal contacts extend over and are engaged in electrical contact with corresponding second signal traces that extend on a second side of the circuit board that is opposite the first side. The ground contacts are held by the housing such that when the housing is mounted to the edge of the circuit board: first ground mounting segments of first ground contacts of the ground contacts extend over and are engaged in electrical contact with corresponding first ground traces that extend on the first side of the circuit board; and second ground mounting segments of second ground contacts of the ground contacts extend over and are engaged in electrical contact with corresponding second ground traces that extend on the second side of the circuit board.

In an embodiment, a coaxial connector assembly includes a circuit board having an edge and electrical signal traces and electrical ground traces arranged on a side thereof, and a coaxial connector. The coaxial connector includes a housing configured to be mounted to the edge of the circuit board, and coaxial contacts held by the housing. The coaxial contacts include coaxial contact pairs having a signal contact and a ground contact that is arranged coaxially with the signal contact of the same coaxial contact pair. The signal contacts are held by the housing such that signal mounting segments of the signal contacts extend over and are engaged in electrical contact with the corresponding electrical signal traces of the circuit board when the housing is mounted to the edge of the circuit board. The ground contacts are held by the housing such that ground mounting segments of the ground contacts are extend over and are engaged in electrical contact with the corresponding electrical ground traces of the circuit board when the housing is mounted to the edge of the circuit board.

DETAILED DESCRIPTION OF THE INVENTION

Figure 1:
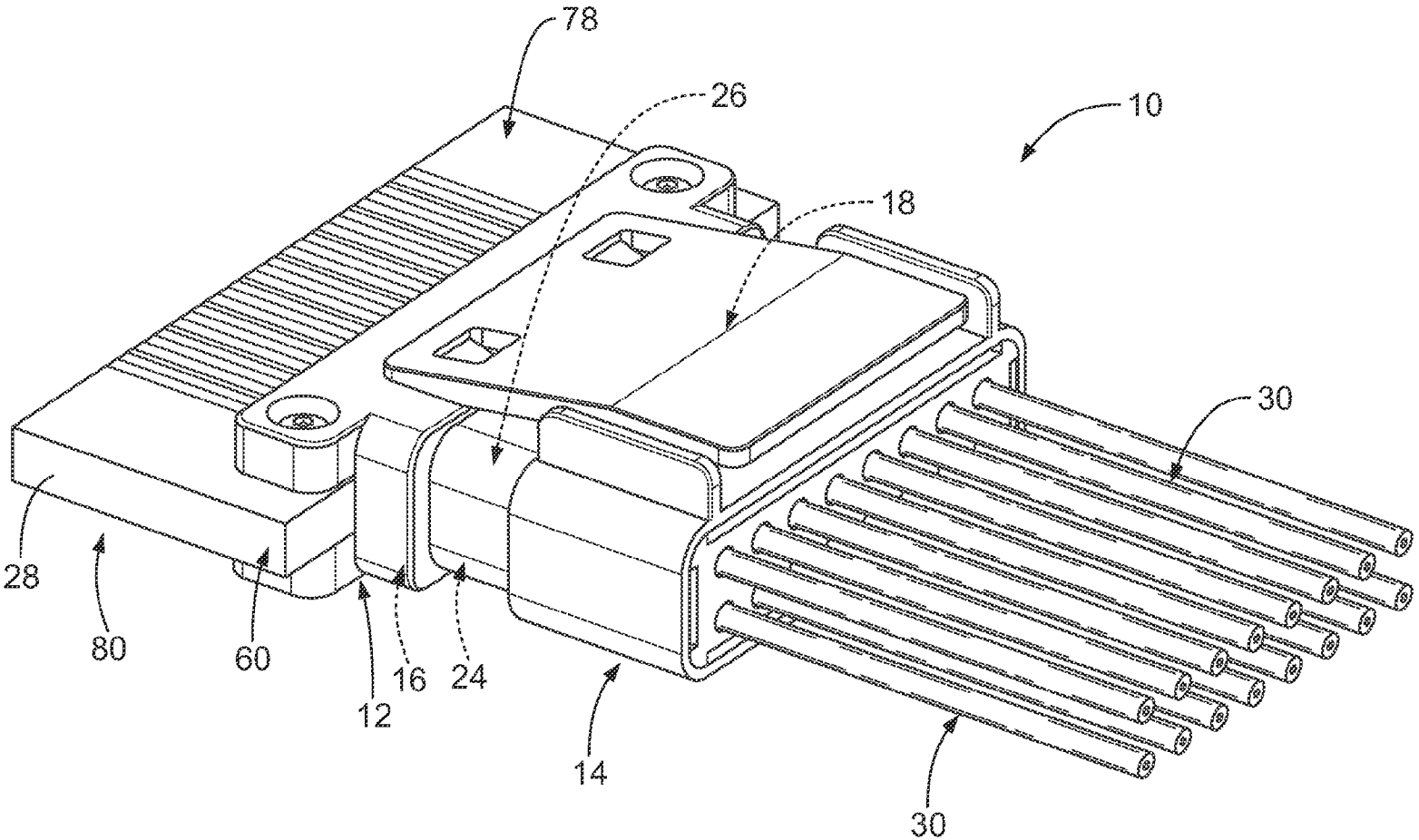
FIG. 1 is a perspective view of an embodiment of a coaxial connector assembly.
Figure 2:
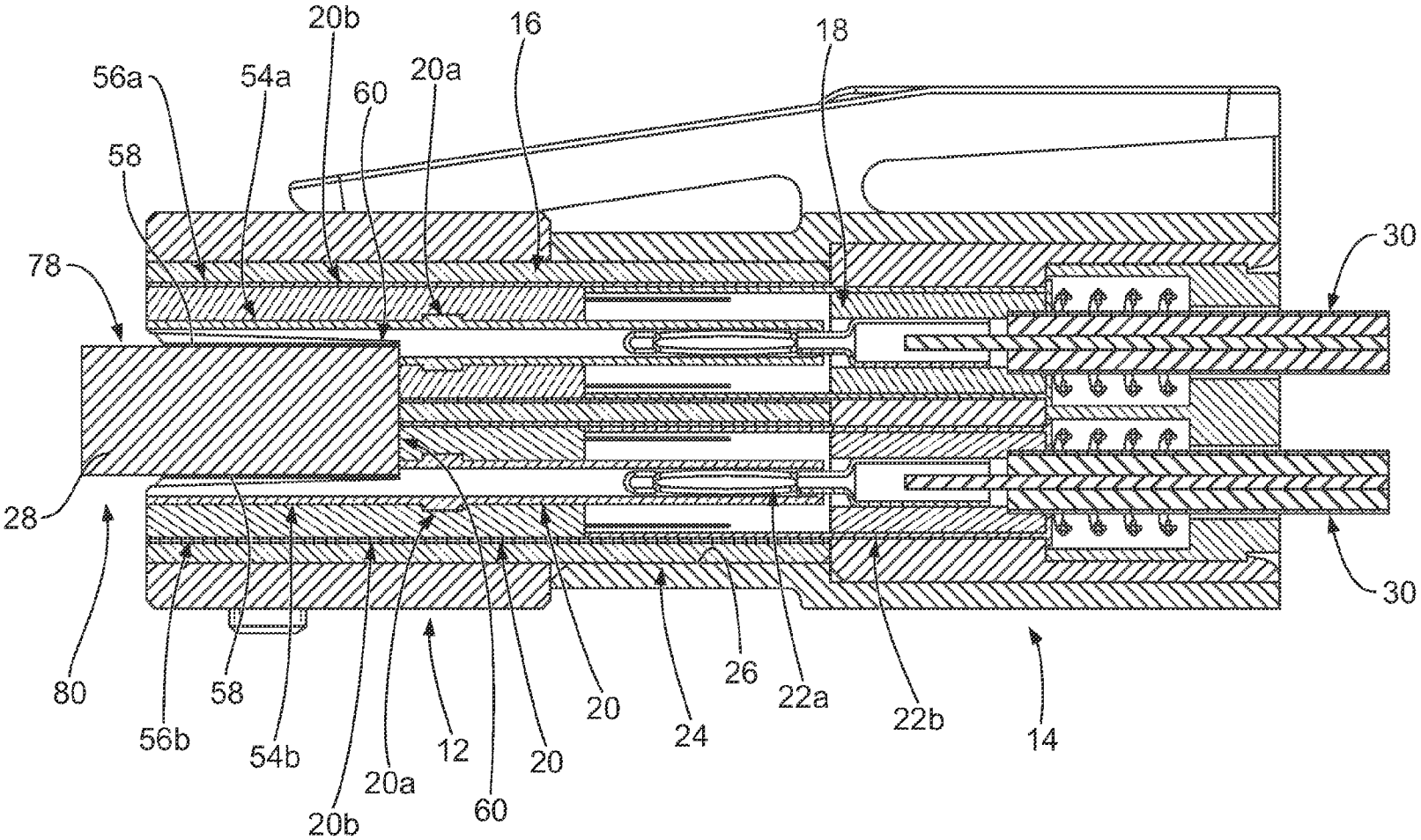
FIG. 2 is a cross-sectional view of the coaxial connector assembly shown in FIG. 1.

FIG. 1 is a perspective view of an embodiment of coaxial connector assembly 10. FIG. 2 is a cross-sectional view of the coaxial connector assembly 10. Referring now to FIGS. 1 and 2, the coaxial connector assembly 10 includes coaxial connectors 12 and 14 that mate together to establish an electrical connection therebetween. As shown in FIG. 2, each of the coaxial connectors 12 and 14 include respective contact assemblies 16 and 18. When the coaxial connectors 12 and 14 are mated together as shown in FIGS. 1 and 2, the contact assemblies 16 and 18 are engaged in electrical contact with each other to establish the electrical connection between the coaxial connectors 12 and 14.

The contact assemblies 16 and 18 include respective coaxial contact pairs 20 and 22 (not visible in FIG. 1) that engage in physical contact with each other to establish the electrical connection between the coaxial connectors 12 and 14. Although the contact assembly 16 of the coaxial connector 12 is shown as including a plug 24 that is received within a receptacle 26 of the coaxial connector 14, additionally or alternatively any other arrangement, configuration, and/or the like may be used.

In the illustrated embodiment, the coaxial connector 12 is mounted to a circuit board 28 and the coaxial connector 14 terminates coaxial cables 30. But the coaxial connector 16 may terminate any other device, such as, but not limited to a circuit board and/or the like. For example, in some embodiments the coaxial connector 12 is mounted to a circuit board (not shown). The coaxial cables 30 may or may not be grouped together within a common jacket (not shown).

Figure 3:
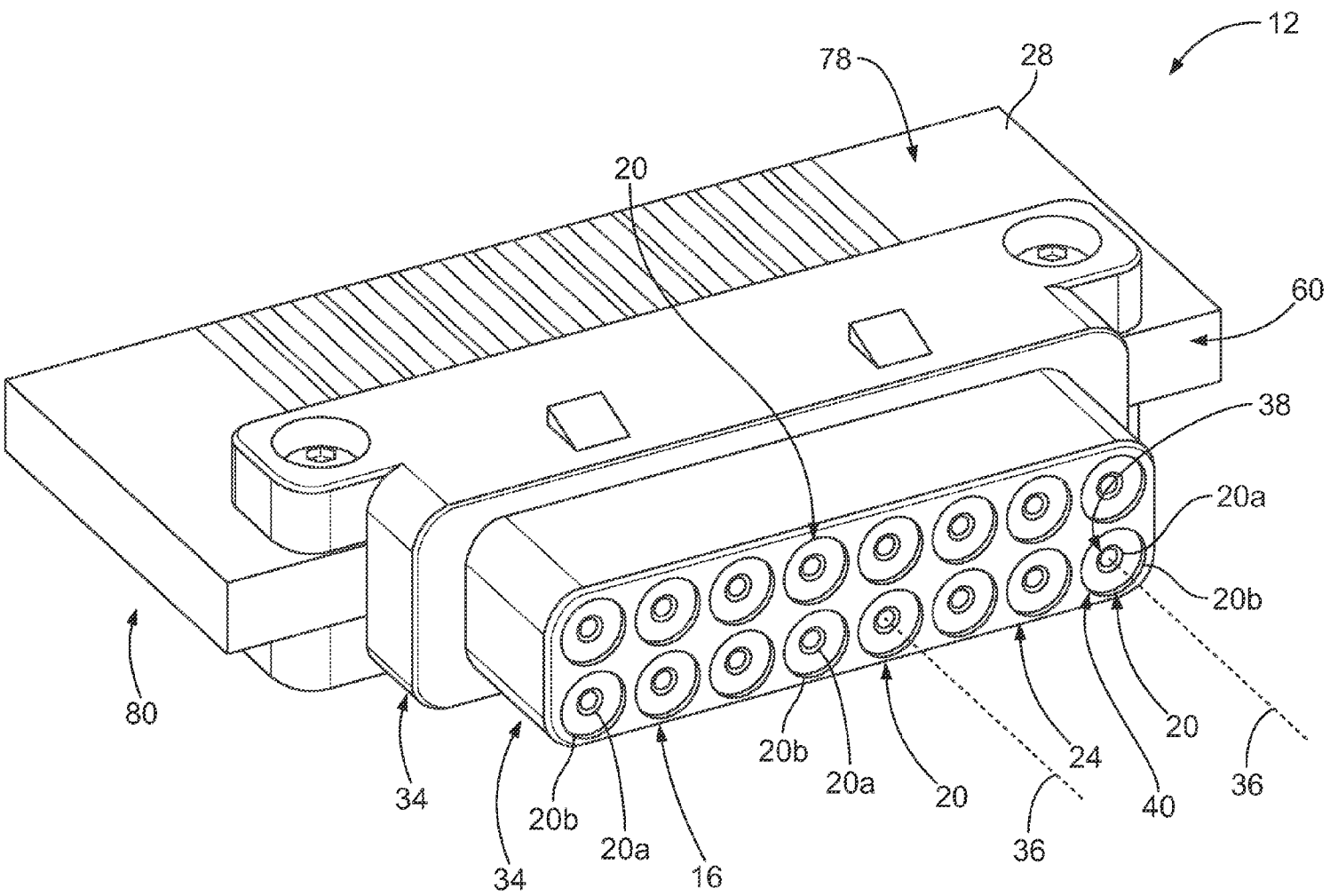
FIG. 3 is a perspective view of an embodiment of a coaxial connector of the coaxial connector assembly shown in FIGS. 1 and 2.
Figure 4:
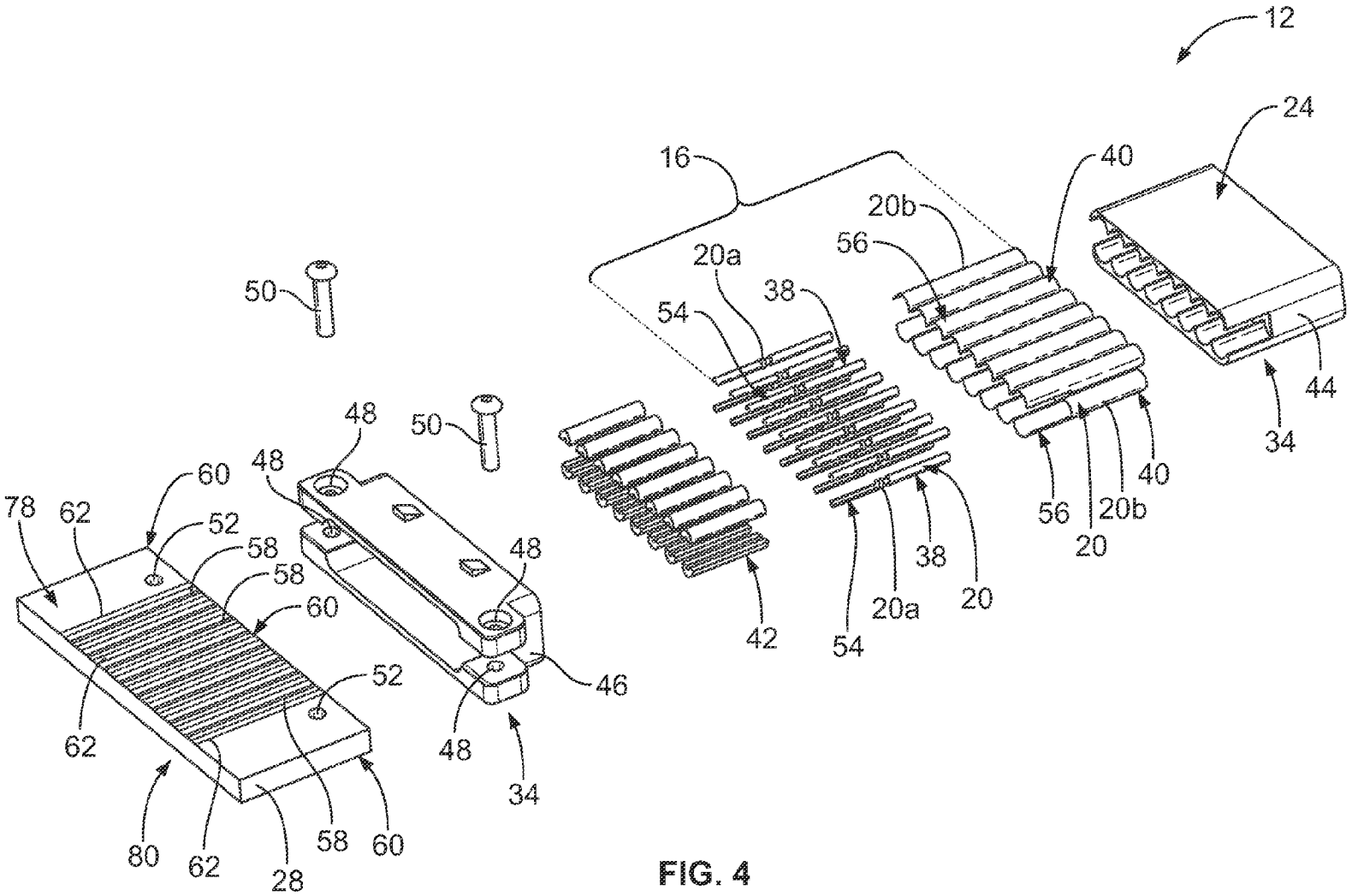
FIG. 4 is an exploded perspective view of the coaxial connector shown in FIG. 3.

FIG. 3 is a perspective view of an embodiment of the coaxial connector 12. FIG. 4 is an exploded perspective view of the coaxial connector 12. The coaxial connector 12 includes a housing 34 and the contact assembly 16, which as shown in FIG. 3 is held by the housing 34. The housing 34 includes the plug 24. As is also shown in FIG. 3, the coaxial connector 12 is mounted to the circuit board 28. The contact assembly 16 of the coaxial connector 12 includes the coaxial contact pairs 20. Each coaxial contact pair 20 includes a signal contact 20*a* and a ground contact 20*b*. The signal contact 20*a* and the ground contact 20*b* of each coaxial contact pair 20 are arranged coaxially. Specifically, each signal contact 20*a* extends a length along a central longitudinal axis 36 (not shown in FIG. 4). The ground contact 20*b* of each coaxial contact pair 20 is centered about the central longitudinal axis 36 and extends around the signal contact 20*a* of the same coaxial contact pair 20. Accordingly, the signal contact 20*a* and the ground contact 20*b* of each coaxial contact pair 20 are arranged coaxially about the corresponding central longitudinal axis 36.

The signal contacts 20*a* of the coaxial contact pairs 20 include mating segments 38 at which the signal contacts 20*a* mate with corresponding signal contacts 22*a* (FIG. 2) of the coaxial connector 14 (FIGS. 1 and 2). Similarly, the ground contacts 20*b* of the coaxial contact pairs 20 include mating segments 40 at which the ground contacts 20*b* mate with corresponding ground contacts 22*b* (FIG. 2) of the coaxial connector 14.

Referring now solely to FIG. 4, the coaxial connector 12 includes the housing 34, the coaxial contact pairs 20, and an insulator 42. In the illustrated embodiment, the housing 34 includes a plug segment 44 and a mounting segment 46. The plug segment 44 of the housing 34 includes the plug 24 of the coaxial connector 12. The mounting segment 46 of the housing 34 is configured to mount the coaxial connector 12 to the circuit board 28. In the illustrated embodiment, the mounting segment 46 includes one or more openings 48 that receive corresponding fasteners 50 that extend through the openings 48 and corresponding openings 52 within the circuit board 28 to mount the coaxial connector 12 to the circuit board 28. But, any other arrangement, configuration, and/or the like additionally or alternatively may be used to mount the coaxial connector 12 to the circuit board 20. Optionally, the plug segment 44 and/or the mounting segment 46 is shielded (e.g., having at least a portion that is electrically conductive, being electrically connected to a source of electrical ground, and/or the like) to facilitate containing electromagnetic interference (EMI) and/or shielding the coaxial connector 12 from EMI. For example, the plug segment 44 and/or the mounting segment 46 of the housing 34 may be plated with a metallic and/or other electrically conductive material.

The signal contacts 20*a* of the coaxial contact pairs 20 include mounting segments 54 at which the signal contacts 20*a* are mounted to the circuit board 28 in electrical connection therewith, as will be described below. Similarly, the ground contacts 20*b* of the coaxial contact pairs 20 include mounting segments 56 at which the ground contacts 20*b* are mounted to the circuit board 28 in electrical connection therewith. The mounting segments 54 of the signal contacts 20*a* may be referred to herein as "signal mounting segments", "first signal mounting segments", and/or "second signal mounting segments", while the mounting segments 56 of the ground contacts 20*b* may be referred to herein as "ground mounting segments", "first ground mounting segments", and/or "second ground mounting segments".

As will be described below, the signal contacts 28 are held by the housing 34 such that the mounting segments 54 of the signal contacts 20*a* are configured to extend over and be engaged in electrical contact with corresponding electrical signal traces 58 of the circuit board 28 when the housing 34 is mounted to an edge 60 of the circuit board 28. Similarly the ground contacts 20*b* are held by the housing 34 such that the mounting segments 56 of the ground contacts 20*b* are configured to extend over and be engaged in electrical contact with corresponding electrical ground traces 62 of the circuit board 28 when the housing 34 is mounted to the edge 60 of the circuit board 28.

At least some of the ground contacts 20*b* are integrally fabricated from the same sheet of material as a single, unitary, continuous structure such that at least some of the ground contacts 20*b* are defined by a single, unitary body 64. In the illustrated embodiment, ail of the ground contacts 20*b* are integrally fabricated from the same sheet of material as a single, unitary, continuous structure such that all of the ground contacts 20*b* of the coaxial contact pairs 20 are defined by the single, unitary body 64. It should be understood that the ground contacts 20*b* that are integrally fabricated from the same sheet of material as a single, unitary, continuous structure are electrically commenced with each other.

One example of a process for integrally fabricating at least some of the ground contacts 20*b* from the same sheet of material as a continuous structure includes cutting the ground contacts 20*b* from a sheet of material and forming informing the cut structure into the finished shape of the body 64 shown herein, which may be referred to herein as a "cut and formed" body. Any cutting process(es) may be used to fabricate the body 64 as a cut and formed body, such as, but not limited to, stamping, laser cutting, water cutting, plasma cutting, cutting using a cutting tool (e.g., a saw, a blade, and/or the like), and/or the like. Moreover, any forming process(es) may be used to fabricate the body 64 as a cut and formed body, such as, but not limited to, compressive forming, tensile forming, combined compressive and tensile forming, bending, shearing, stamping, die forming, forging, indenting, rolling, stretching, expanding, recessing, deep drawing, spinning, flange forming, upset bulging, and/or the like. In some embodiments, the body 64 is a stamped and formed body that is stamped from a sheet of material. In such embodiments wherein the body 64 is a stamped and formed body, any other type and/or number of forming methods optionally may be used in addition to the stamping process(es) to fabricate the body 64 as a stamped and formed body.

Integrally fabricating at least some of the ground contacts 20*b* from the same sheet of material as a continuous structure, for example using a cutting and forming process, may reduce the size of the ground contacts 20*b*,which may enable the coaxial connector 12 to hold a greater density of coaxial contact pairs 20. Integrally fabricating at least some of the ground contacts 20*b* from the same sheet of material as a continuous structure, for example using a cutting and forming process, may reduce a cost of the coaxial connector 12.

The signal contacts 20*a* may be fabricated using any process, method, and/or the like. In the illustrated embodiment, the signal contacts 20*a* are fabricated using a screw-machining process. In other embodiments, the signal contacts 20*a* may be fabricated using a cutting and forming process.

Figure 5:
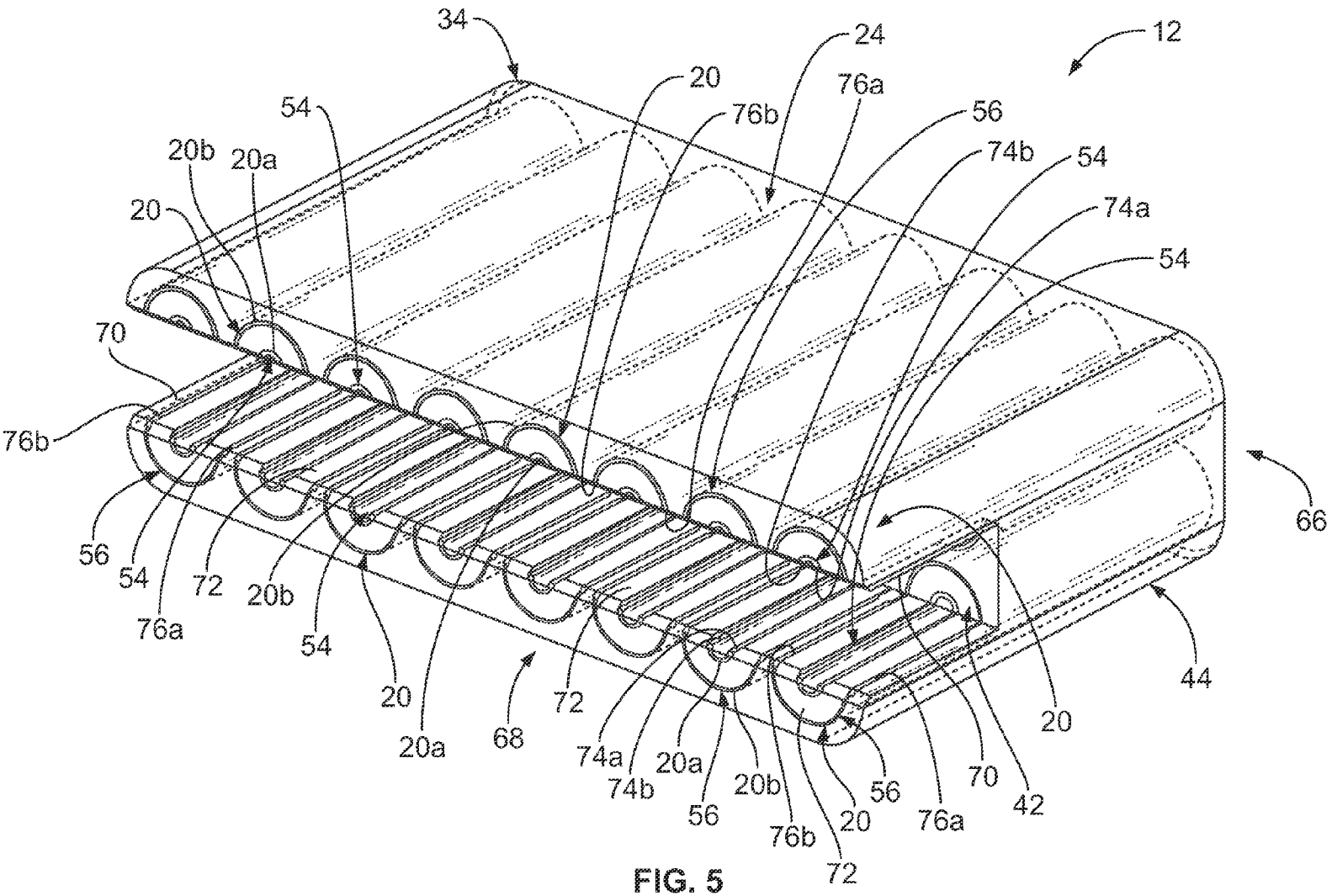
FIG. 5 is a perspective view of a portion of the coaxial connector shown in FIGS. 3 and 4.

FIG. 5 is a perspective view of a portion of the coaxial connector 12. FIG. 5 illustrates the coaxial contact pairs 20 and the insulator 42 as held by the plug segment 44 of the housing 34. The housing 34 is shown in phantom in FIG. 5 for clarity. The plug segment 44 of the housing 34 extends from a mating end 66 to a mounting end 68. The mating end 66 includes the plug 24 of the housing 34 for mating with the coaxial connector 14 (FIGS. 1 and 2). The mounting end 68 is configured to be mounted to the edge 60 (FIGS. 1-4, 6, and 7) of the circuit board 28 (FIGS. 1-4, 6, and 7). Specifically, in the illustrated embodiment, the mounting end 68 of the plug segment 44 of the housing 34 includes a slot 70 that is configured to receive the edge 60 of the circuit board 28 therein. Optionally, the coaxial connector 12 is configured to straddle the edge 60 of the circuit board 28, as will be described below.

As can be seen in FIG. 5, the insulator 42 extends between the ground contact 20*b* and the signal contact 20*a* of each coaxial contact pair 20. The insulator 42 thus electrically isolates the ground contacts 20*b* from the signal contacts 20*a*. At the mounting end 68 of the plug segment 44 of the housing 34, and as shown in FIG. 5, the insulator 42 includes fingers 72 that extend between the ground contact 20*b* and the signal contact 20*a* of the corresponding coaxial contact pair 20.

In the illustrated embodiment, the mounting segments 54 of the signal contacts 20*a* have partially cylindrical shapes, as can be seen in FIG. 5. Specifically, the mounting segment 54 of each signal contact 20*a* includes a curved cross-sectional profile that forms a portion of a circle. As shown in FIG. 5, the partially cylindrical shapes of the signal contacts 20*a* include free edges 74*a* and 74*b*. As will be described below, at least one of the free edges 74*a* and/or 74*b* of each signal contact mounting segment 54 is configured to extend over and be engaged in electrical contact with the corresponding electrical signal trace 58 (FIGS. 2, 4, 6, and 7) of the circuit board 28.

The mounting segment 54 of each signal contact 20*a* may form any amount of a circle (i.e., any amount of a cylinder), such as, but not limited to, a half-circle, a quarter of a circle, a third of a circle, and/or the like. In the illustrated embodiment the mounting segment 54 of each signal contact 20*a* forms an approximate half-circle such that the mounting segment 54 forms approximately half of a cylinder. The signal contacts 20*a* are not limited to the cylindrical (i.e., circular cross-sectional) shapes shown herein. Rather, in other embodiments the signal contacts 20*a* additionally or alternatively may include any other shape that enables the signal contacts 20*a* to function as described and/or illustrated herein. Although 16 are shown, the coaxial connector 12 may include any number of the signal contacts 20*a*.

As shown in FIG. 5, the mounting segments 56 of the ground contacts 20*b* also have partially cylindrical shapes in the illustrated embodiment. Specifically, the mounting segment 56 of each ground contact 20*b* includes a curved cross-sectional profile that forms a portion of a circle. The partially cylindrical shapes of the ground contacts 20*b* include free edges 76*a* and 76*b*. At least one of the free edges 76*a* and/or 76*b* of each ground contact mounting segment 56 is configured to extend over and be engaged in electrical contact with the corresponding electrical ground trace 60 (FIGS. 2, 4, 6, and 7) of the circuit board 28, as will be described below.

Each mounting segment 56 may form any amount of a circle (i.e., any amount of a cylinder), such as, but not limited to, a half circle, a quarter of a circle, a third of a circle, and/or the like. In the illustrated embodiment, the mounting segment 56 of each ground contact 20*b* forms an approximate hail-circle such that the mounting segment 56 forms approximately half of a cylinder. The ground contacts 20*b* are not limited to the cylindrical (i.e., circular cross-sectional) shapes shown herein. Rather, in other embodiments the ground contacts 20*b* additionally or alternatively may include any other shape that enables the ground contacts 20*b* to function as described and/or illustrated herein. The coaxial connector 12 may include any number of the ground contacts 20*b*.

Figure 6:
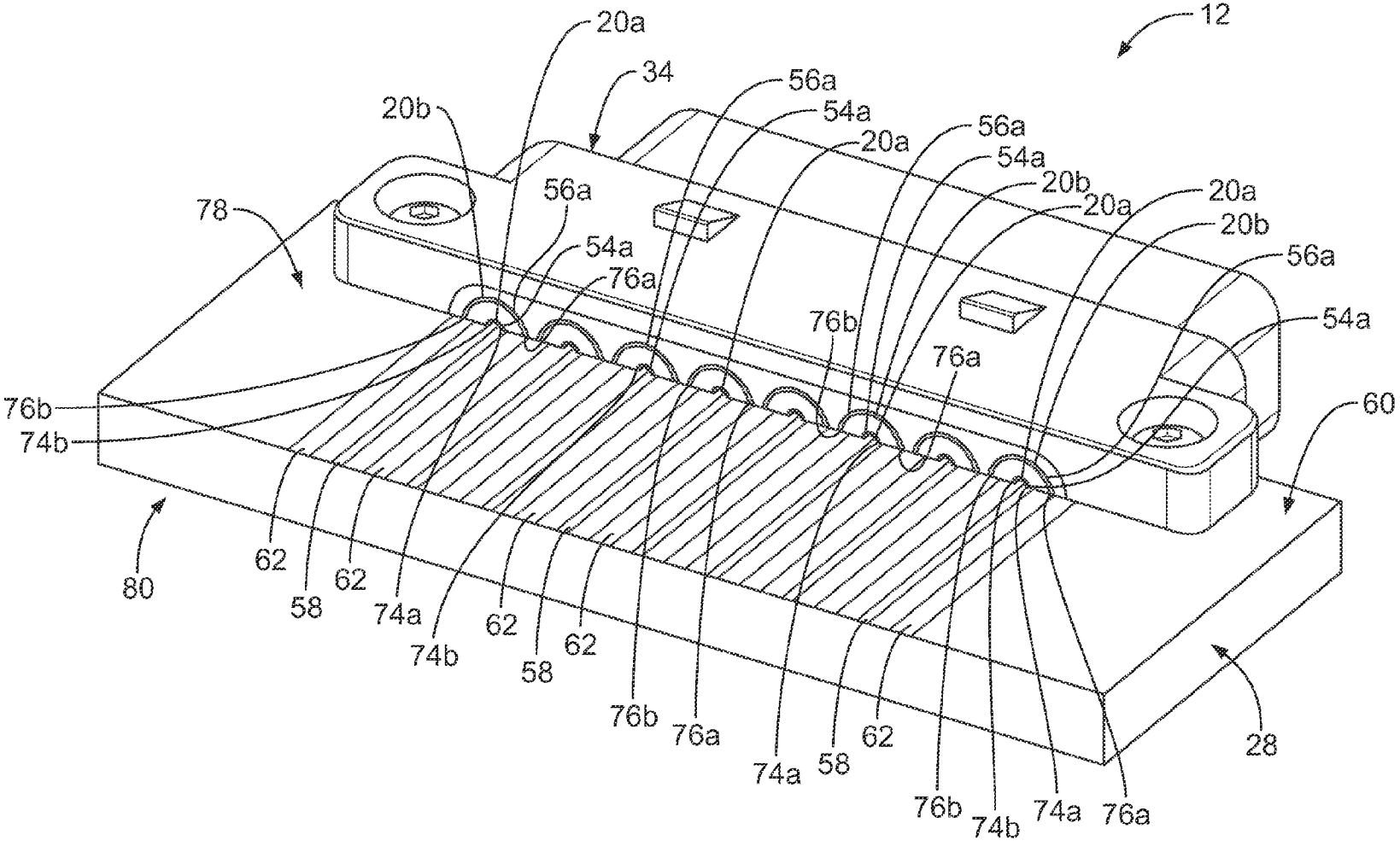
FIG. 6 is a another perspective view of the coaxial connector shown in FIGS. 3-5 illustrating the coaxial connector mounted to a circuit board.

FIG. 6 is a another perspective view of the coaxial connector 12. FIG. 6 illustrates the coaxial connector 12 is mounted to the circuit board 28. The circuit board 28 includes opposite sides 78 and 80, which are also labeled in FIGS. 1-4 and 7. As shown in FIG. 6 and was also described with respect to FIG. 4, the side 78 of the circuit board 28 includes the electrical signal traces 58 and the electrical ground traces 62. In the illustrated embodiment, each electrical signal trace 58 extends between two adjacent electrical ground traces 62. Although not visible in FIG. 6, the side 80 of the circuit board 28 also includes electrical signal traces 58 and electrical ground traces 62. The electrical signal traces 58 and the electrical ground traces 62 that extend on the side 80 of the circuit board 28 can be seen in, and will be described below with respect to, FIG. 7. Each of the sides 78 and 80 of the circuit board 28 may be referred to herein as a "first" and/or a "second" side. The electrical ground traces 62 that extend on the side 78 of the circuit board 28 may be referred to herein as "first" and/or "second" ground traces. The electrical signal traces 58 that extend on the side 78 of the circuit board 28 may be referred to herein as "first" and/or "second" signal traces.

As shown in FIG. 6, the ground contacts 20*b* are held by the housing 34 and the housing 34 is mounted to the edge 60 of the circuit board 28 such that mounting segments 56*a* of the ground contacts 20*b* extend over the corresponding electrical ground traces 62 on the side 78 of the circuit board 28. Specifically, at least one of the free edges 76*a* and/or 76*b* of each ground mounting segment 56*a* extends over a corresponding electrical ground trace 62 on the side 78 of the circuit board 28. At least one of the free edges 76*a* and/or 76*b* of each ground mounting segment 56*a* is engaged in electrical contact with a corresponding electrical ground trace 62 on the side 78 of the circuit board 28. The ground mounting segments 56*a* of the ground contacts 20*b* are thus electrically connected to the corresponding electrical ground trace(s) 62 on the side 78 of the circuit board 28. The ground mounting segments 56*a* may be referred to herein as "first ground mounting segments" and/or "second ground mounting segments".

The free edge 76*a* and/or 76*b* of each ground mounting segment 56*a* may be engaged in electrical contact with the corresponding electrical ground trace 62 in any manner, such as not limited to via direct physical contact, via solder and/or another electrically conductive material, and/or the like. For example, in some embodiments, solder is applied to the free edge 76*a* and/or 76*b* of one or more of the ground mounting segments 56*a* before the coaxial connector 12 is mounted to the edge 60 of the circuit board 28.

In the illustrated embodiment, both the free edge 76*a* and the free edge 76*b* of each ground mounting segment 56*a* is engaged in electrical contact with a corresponding electrical ground trace 62 on the side 78 of the circuit board 28. In other words, in the illustrated embodiment, each ground mounting segment 56*a* is engaged with two corresponding electrical ground traces 62, namely the two electrical ground traces 62 that straddle the corresponding electrical signal trace 58 of the corresponding signal contact 20*a* of the same coaxial contact pair 20. But, in other embodiments, only one of the free edges 76*a* or 76*b* of one or more of the ground mounting segments 56*a* is engaged in electrical contact with a corresponding electrical ground trace 62 on the side 78 of the circuit board 28. In other words, in some other embodiments, one or more of the ground mounting segments 56*a* is engaged in electrical contact with only a single corresponding electrical ground trace 62 on the side 78 of the circuit board 28. Optionally, and as shown in FIG. 6, the free edge 76*a* and 76*b* of adjacent ground mounting segments 56*a* (i.e., of adjacent ground contacts 20*b*) may extend over and be engaged in electrical contact with the same electrical ground trace 62 on the side 78 of the circuit board 28.

Referring now to the signal contacts 20*a*,the signal contacts 20*a* are held by the housing 34 and the housing 34 is mounted to the edge 60 of the circuit board 28 such that mounting segments 54*a* of the signal contacts 20*a* extend over the corresponding electrical signal traces 58 on the side 78 of the circuit board 28. At least one of the free edges 74*a* and/or 74*b* of each signal mounting segment 54*a* extends over a corresponding electrical signal trace 58 on the side 78 of the circuit board 28. At least one of the free edges 74*a* and/or 74*b* of each signal mounting segment 54*a* is engaged in electrical contact with a corresponding electrical signal trace 58 on the side 78 of the circuit board 28. The signal mounting segments 54*a* of the signal contacts 20*a* are thus electrically connected to the corresponding electrical signal trace(s) 58 on the side 78 of the circuit board 28. The electrical engagement of the signal mounting segments 54*a* of the signal contacts 20*a* with the electrical signal traces 58 on the side 78 of the circuit board 28 can also be seen in FIG. 2. The signal mounting segments 54*a* may be referred to herein as "first signal mounting segments" and/or "second signal mounting segments".

The free edge 74*a* and/or 74*b* of each signal mounting segment 54*a* may be engaged in electrical contact with the corresponding electrical signal trace 58 in any manner, such as not limited to via direct physical contact, via solder and/or another electrically conductive material, and/or the like. For example, in some embodiments, solder is applied to the free edge 74*a* and/or 74*b* of one or more of the signal mounting segments 54*a* before the coaxial connector 12 is mounted to the edge 60 of the circuit board 28.

In the illustrated embodiment, only the free edges 74*a* of the signal mounting segments 54*a* are engaged in electrical contact with a corresponding electrical signal trace 58 on the side 78 of the circuit board 28. But, in other embodiments, both of the free edges 74*a* and 74*b* of one or more of the signal mounting segments 54*a* is engaged in electrical contact with a corresponding electrical signal trace 58 (which may or may not be the same electrical signal trace 58) on the side 78 of the circuit board 28.

Figure 7:
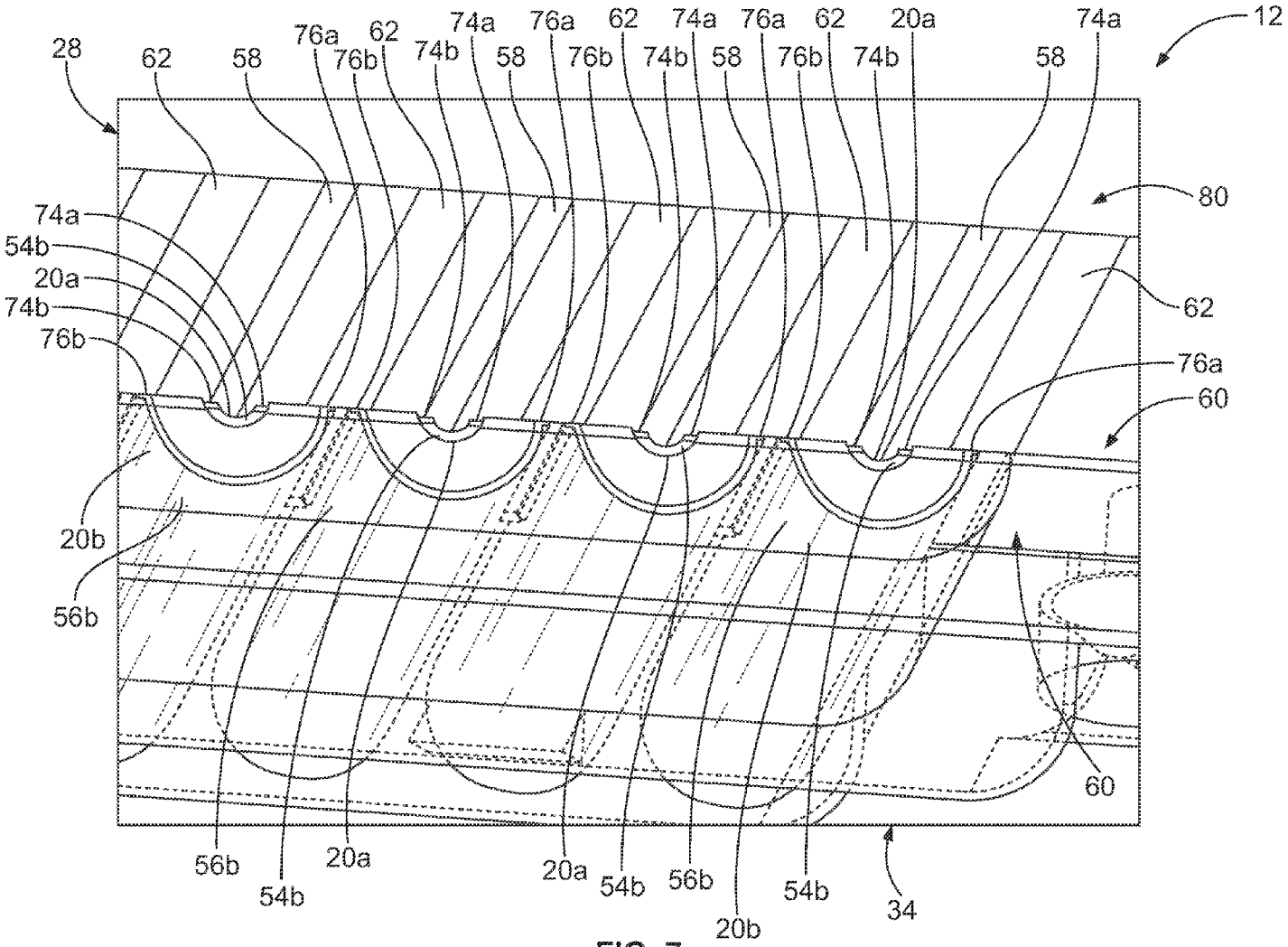
FIG. 7 is another perspective view of a portion of the coaxial connector shown in FIGS. 3-6 illustrating an opposite side of the circuit board shown in FIG. 6.

FIG. 7 is another perspective view of a portion of the coaxial connector 12 illustrating the side 80 of the circuit board 28. The housing 34 is shown in phantom in FIG. 7 for clarity. In the illustrated embodiment, the coaxial connector 12 is configured to straddle the edge 60 of the circuit board 28. In other words, the coaxial connector 12 is configured to be electrically connected to electrical signal traces 58 and electrical ground traces 62 on both sides 78 and 80 of the circuit board 28. In other embodiments, the coaxial connector 12 does not straddle the edge 60 of the circuit board 28 such that the coaxial connector 12 is only electrically connected to electrical signal traces 58 and electrical ground traces 62 on one of the sides 78 or 80 of the circuit board 28. The straddling of the edge 60 of the circuit board 28 by the coaxial connector 12 is best seen in FIG. 2.

The electrical ground traces 62 that extend on the side 80 of the circuit board 28 may be referred to herein as "first" and/or "second" ground traces. The electrical signal traces 58 that extend on the side 80 of the circuit board 28 may be referred to herein as "first" and/or "second" signal traces.

As shown in FIG. 7, in the illustrated embodiment, the ground contacts 20*b* are held by the housing 34 and the housing 34 is mounted to the edge 60 of the circuit board 28 such that mounting segments 56*b* of the ground contacts 20*b* extend over the corresponding electrical ground traces 62 on the side 80 of the circuit board 28. Specifically, at least one of the free edges 76*a* and/or 76*b* of each ground mounting segment 56*b* extends over a corresponding electrical ground trace 62 on the side 80 of the circuit board 28. At least one of the free edges 76*a* and/or 76*b* of each ground mounting segment 56*b* is engaged in electrical contact with a corresponding electrical ground trace 62 on the side 80 of the circuit board 28. The ground mounting segments 56*b* of the ground contacts 20*b* are thus electrically connected to the corresponding electrical ground trace(s) 62 on the side 80 of the circuit board 28. The ground mounting segments 56*b* may be referred to herein as "first ground mounting segments" and/or "second ground mounting segments".

The free edge 76*a* and/or 76*b* of each ground mounting segment 56*b* may be engaged in electrical contact with the corresponding electrical ground trace 62 in any manner, such as not limited to via direct physical contact, via solder and/or another electrically conductive material, and/or the like. For example, in some embodiments, solder is applied to the free edge 76*a* and/or 76*b* of one or more of the ground mounting segments 56*b* before the coaxial connector 12 is mounted to the edge 60 of the circuit board 28.

In the illustrated embodiment, both the free edge 76*a* and the free edge 76*b* of each ground mounting segment 56*b* is engaged in electrical contact with a corresponding electrical ground trace 62 on the side 80 of the circuit board 28. In other words, in the illustrated embodiment, each ground mounting segment 56*b* is engaged with two corresponding electrical ground traces 62, namely the two electrical ground traces 62 that straddle the corresponding electrical signal trace 58 of the corresponding signal contact 20*a* of the same coaxial contact pair 20. But, in other embodiments, only one of the free edges 76*a* or 76*b* of one or more of the ground mounting segments 56*b* is engaged in electrical contact with a corresponding electrical ground trace 62 on the side 80 of the circuit board 28. In other words, in some other embodiments, one or more of the ground mounting segments 56*b* is engaged in electrical contact with only a single corresponding electrical ground trace 62 on the side 80 of the circuit board 28. Optionally, and as shown in FIG. 7, the free edge 76*a* and 76*b* of adjacent ground mounting segments 56*b* (i.e., of adjacent ground contacts 20*b*) may extend over and be engaged in electrical contact with the same electrical ground trace 62 on the side 80 of the circuit board 28.

Referring now to the signal contacts 20*a*,the signal contacts 20*a* are held by the housing 34 and the housing 34 is mounted to the edge 60 of the circuit board 28 such that mounting segments 54*b* of the signal contacts 20*a* extend over the corresponding electrical signal traces 58 on the side 80 of the circuit board 28. At least one of the free edges 74*a* and/or 74*b* of each signal mounting segment 54*b* extends over a corresponding electrical signal trace 58 on the side 80 of the circuit board 28. At least one of the free edges 74*a* and/or 74*b* of each signal mounting segment 54*b* is engaged in electrical contact with a corresponding electrical signal trace 58 on the side 80 of the circuit board 28. The signal mounting segments 54*b* of the signal contacts 20*a* are thus electrically connected to the corresponding electrical signal trace(s) 58 on the side 80 of the circuit board 28. The electrical engagement of the signal mounting segments 54*b* of the signal contacts 20*a* with the electrical signal traces 58 on the side 80 of the circuit board 28 can also be seen in FIG. 2. The signal mounting segments 54*b* may be referred to herein as "first signal mounting segments" and/or "second signal mounting segments".

The free edge 74*a* and/or 74*b* of each signal mounting segment 54*b* may be engaged in electrical contact with the corresponding electrical signal trace 58 in any manner, such as not limited to via direct physical contact, via solder and/or another electrically conductive material, and/or the tike. For example, in some embodiments, solder is applied to the free edge 74*a* and/or 74*b* of one or more of the signal mounting segments 54*b* before the coaxial connector 12 is mounted to the edge 60 of the circuit board 28.

In the illustrated embodiment, only the tree edges 74*a* of the signal mounting segments 54*b* are engaged in electrical contact with a corresponding electrical signal trace 58 on the side 80 of the circuit board 28. But, in other embodiments, both of the free edges 74*a* and 74*b* of one or more of the signal mounting segments 54*b* is engaged in electrical contact with a corresponding electrical signal trace 58 (which may or may not be the same electrical signal trace 58) on the side 80 of the circuit board 28.

The embodiments described and/or illustrated herein may provide a coaxial connector that has smaller contacts.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A coaxial connector comprising:

a housing configured to be mounted to an edge of a circuit board; and coaxial contacts held by the housing, the coaxial contacts comprising coaxial contact pairs that each include a signal contact and a ground contact that is arranged coaxially with the signal contact of the same coaxial contact pair, the signal contacts being held by the housing such that signal mounting segments of the signal contacts are configured to extend over and be engaged in electrical contact with corresponding electrical signal traces of the circuit board when the housing is mounted to the edge of the circuit board, the ground contacts being held by the housing such that ground mounting segments of the ground contacts are configured to extend over and be engaged in electrical contact with corresponding electrical ground traces of the circuit board when the housing is mounted to the edge of the circuit board, wherein two of the ground contacts are configured to extend over and be engaged in electrical contact with the same electrical ground trace.

2. The coaxial connector of claim 1, wherein at least one of the ground contacts is a cut and formed ground contact that is cut from a sheet of material.

3. The coaxial connector of claim 1, wherein at least some of the ground contacts are integrally fabricated from the same sheet of material as a single, unitary, continuous structure.

4. The coaxial connector of claim 1, wherein at least one of the ground mounting segments of the ground contacts or the signal mounting segments of the signal contacts have partially cylindrical shapes.

5. The coaxial connector of claim 1, wherein the ground mounting segments of the ground contacts have partially cylindrical shapes, and wherein a free edge of the partially cylindrical shape is configured to extend over and be engaged in electrical contact with the corresponding electrical ground trace when the housing is mounted to the edge of the circuit board.

6. The coaxial connector of claim 1, wherein the signal mounting segments of the signal contacts have partially cylindrical shapes, and wherein a free edge of the partially cylindrical shape is configured to extend over and be engaged in electrical contact with the corresponding electrical signal trace when the housing is mounted to the edge of the circuit board.

7. The coaxial connector of claim 1, wherein the ground contacts are configured to straddle the edge of the circuit board when the housing is mounted to the edge of the circuit board such that first ground mounting segments extend over and are engaged in electrical contact with corresponding first ground traces of the circuit board that extend on a first side of the circuit board and such that second ground mounting segments extend over and are engaged in electrical contact with corresponding second ground traces that extend on a second side of the circuit board that is opposite the first side.

8. The coaxial connector of claim 1, wherein the signal contacts are configured to straddle the edge of the circuit board when the housing is mounted to the edge of the circuit board such that first signal mounting segments extend over and are engaged in electrical contact with corresponding first signal traces of the circuit board that extend on a first side of the circuit board and such that second signal mounting segments extend over and are engaged in electrical contact with corresponding second signal traces that extend on a second side of the circuit board that is opposite the first side.

9. The coaxial connector of claim 1, wherein each electrical signal trace extends between two adjacent electrical ground traces, and wherein each ground contact is configured to extend over and be engaged in electrical contact with both of the two adjacent electrical ground traces of the electrical signal trace of the corresponding signal contact when the housing is mounted to the edge of the circuit board.

10. The coaxial connector assembly of claim 1, wherein the housing comprises a plug segment and a mounting segment, and the coaxial contacts are held by the plug segment.

11. The coaxial connector of claim 1, wherein the ground contacts are electrically commoned with each other.

12. The coaxial connector of claim 1, wherein at least one of at least one ground contact or at least one signal contact is configured to be at least partially engaged in electrical contact with the corresponding electrical ground or signal trace, respectively, via solder.

13. A coaxial connector comprising:

a housing configured to be mounted to an edge of a circuit board; and coaxial contacts held by the housing, the coaxial contacts comprising coaxial contact pairs that each include a signal contact and a ground contact that is arranged coaxially with the signal contact of the same coaxial contact pair, the signal contacts being held by the housing such that when the housing is mounted to the edge of the circuit board:

first signal mounting segments of first signal contacts of the signal contacts extend over and are engaged in electrical contact with corresponding first signal traces that extend on a first side of the circuit board; and second signal mounting segments of second signal contacts of the signal contacts extend over and are engaged in electrical contact with corresponding second signal traces that extend on a second side of the circuit board that is opposite the first side, the ground contacts being held by the housing such that when the housing is mounted to the edge of the circuit board:

first ground mounting segments of first ground contacts of the ground contacts extend over and are engaged in electrical contact with corresponding first ground traces that extend on the first side of the circuit board, wherein two of the first ground contacts are configured to extend over and be engaged in electrical contact with the same first ground trace; and second ground mounting segments of second ground contacts of the ground contacts extend over and are engaged in electrical contact with corresponding second ground traces that extend on the second side of the circuit board, wherein two of the second ground contacts are configured to extend over and be engaged in electrical contact with the same second ground trace.

14. The coaxial connector of claim 13, wherein at least one of the ground contacts is a cut and formed ground contact that is cut from a sheet of material.

15. The coaxial connector of claim 13, wherein at least some of the ground contacts are integrally fabricated from the same sheet of material as a single, unitary, continuous structure.

16. The coaxial connector of claim 13, wherein at least one of the ground mounting segments of the ground contacts or the signal mounting segments of the signal contacts have partially cylindrical shapes.

17. The coaxial connector of claim 13, wherein the first ground mounting segments have partially cylindrical shapes and the second ground mounting segments have partially cylindrical shapes, and wherein a free edge of the partially cylindrical shape extends over and is engaged in electrical contact with the corresponding first or second ground trace when the housing is mounted to the edge of the circuit board.

18. The coaxial connector of claim 13, wherein the first signal mounting segments have partially cylindrical shapes and the second signal mounting segments have partially cylindrical shapes, and wherein a free edge of the partially cylindrical shape extends over and is engaged in electrical contact with the corresponding first or second signal trace when the housing is mounted to the edge of the circuit board.

19. The coaxial connector of claim 13, wherein at least one of at least one ground contact or at least one signal contact is configured to be at least partially engaged in electrical contact with the corresponding ground or signal trace, respectively, via solder.

20. A coaxial connector assembly comprising:

a circuit board having an edge and electrical signal traces and electrical ground traces arranged on a side thereof; and a coaxial connector comprising:

a housing configured to be mounted to the edge of the circuit board; and coaxial contacts held by the housing, the coaxial contacts comprising coaxial contact pairs that each include a signal contact and a ground contact that is arranged coaxially with the signal contact of the same coaxial contact pair, the signal contacts being held by the housing such that signal mounting segments of the signal contacts extend over and are engaged in electrical contact with the corresponding electrical signal traces of the circuit board when the housing is mounted to the edge of the circuit board, the ground contacts being held by the housing such that ground mounting segments of the ground contacts are extend over and are engaged in electrical contact with the corresponding electrical ground traces of the circuit board when the housing is mounted to the edge of the circuit board, wherein two of the ground contacts are configured to extend over and be engaged in electrical contact with the same electrical ground trace.

* * * * *